US010646081B2

(12) United States Patent
Segal et al.

(10) Patent No.: US 10,646,081 B2
(45) Date of Patent: May 12, 2020

(54) UNIVERSAL LIFTER FOR TOILET SEAT AND LID

(71) Applicants: Uzi Segal, Tel-Mond (IL); Amos Wachman, Ein-hod (IL)

(72) Inventors: Uzi Segal, Tel-Mond (IL); Amos Wachman, Ein-hod (IL)

( * ) Notice: Subject to any disclaimer, the term of this patent is extended or adjusted under 35 U.S.C. 154(b) by 55 days.

(21) Appl. No.: 15/778,565

(22) PCT Filed: Nov. 21, 2016

(86) PCT No.: PCT/IL2016/051248
§ 371 (c)(1),
(2) Date: May 23, 2018

(87) PCT Pub. No.: WO2017/090030
PCT Pub. Date: Jun. 1, 2017

(65) Prior Publication Data

US 2018/0344108 A1 Dec. 6, 2018

(30) Foreign Application Priority Data

Nov. 25, 2015 (IL) ..... 242774

(51) Int. Cl.
*A47K 13/10* (2006.01)

(52) U.S. Cl.
CPC ..... *A47K 13/105* (2013.01)

(58) Field of Classification Search
CPC ..... A47K 13/105; A47K 13/10
See application file for complete search history.

(56) References Cited

U.S. PATENT DOCUMENTS 3,618,431 A 11/1971 Nockleby
3,783,455 A * 1/1974 Vanderbrook ..... A47K 13/105 4/237

(Continued)

FOREIGN PATENT DOCUMENTS

| | | |
|---|---|---|
| DE | 10029576 | 12/2001 |
| GB | 2425316 | 10/2006 |
| JP | 2014036829 | 2/2014 |

OTHER PUBLICATIONS https://www.kickstarter.com/projects/1546329370/liftkleen-never-touch-a-toilet-seat-again?ref=category.

(Continued)

*Primary Examiner* — Janie M Loeppke
(74) *Attorney, Agent, or Firm* — The Roy Gross Law Firm, LLC; Roy Gross

(57) ABSTRACT

A bi-functional, touch-free lifter for toilet lid and seat with structure that enables joint lifting of the toilet seat and lid and separate lifting of the lid from the seat. The lifter comprises handle for manual holding of the lifter, engagement part for engaging with the lid, lower support of lifting the seat and flexible neck at the intersection between the handle, engagement part and lower support. The lifter prevents contact with parts of the toilet with high risk for carrying contamination left after use and indirect transfer to other users. Further, users are provided with better sanitary conditions and feeling when not required to be physically exposed to possible contamination accumulated on the toilet seat and lid. Rather only a small area of a user thumb lightly contacts the lifter of the present invention, thus minimizing the exposure to potential contamination.

19 Claims, 8 Drawing Sheets

(56) References Cited

U.S. PATENT DOCUMENTS

| | | | | |
|---|---|---|---|---|
| 3,935,601 | A | 2/1976 | Hermann | |
| 4,856,140 | A | 8/1989 | Visco et al. | |
| 4,951,324 | A | 8/1990 | Lirette | |
| 5,237,708 | A * | 8/1993 | Zamoyski | A47K 13/10 4/246.1 |
| 5,619,758 | A | 4/1997 | Burkett | |
| 5,933,876 | A | 8/1999 | Simonds | |
| 6,163,894 | A | 12/2000 | Simonds | |
| 6,415,454 | B1 | 7/2002 | Pierson | |
| 6,842,916 | B1 | 1/2005 | Gunn et al. | |
| 6,983,492 | B1 | 1/2006 | Larson | |
| 7,676,857 | B1 | 3/2010 | Zuidema | |
| 8,256,035 | B1 | 9/2012 | Eguchi | |
| 8,402,571 | B1 * | 3/2013 | Pagett | A47K 13/105 292/125 |
| 2008/0104744 | A1 | 5/2008 | Aviles Garcia | |
| 2009/0089921 | A1 * | 4/2009 | Olowofela | A47K 13/105 4/246.1 |
| 2011/0214226 | A1 | 9/2011 | Dundas | |
| 2013/0036540 | A1 | 2/2013 | Alexenko | |
| 2015/0182080 | A1 * | 7/2015 | Beumer | A47K 13/105 428/41.8 |

OTHER PUBLICATIONS http://www.ebay.com/itm/New-2p-Anti-microbial-Toilet-Bowl-Seat-Cover-Lifter-Hygienic-Toilet-Cover-Handle-/351343399520?pt=LH_DefaultDomain_0&hash=item51cdb2d260.

http://www.ebay.com/itm/2-Toilet-Seat-Lifters-Up-Down-Hygienic-Handling-of-Lids-Self-Adhesive-Removable-/321380887939?pt=LH_DefaultDomain_0&hash=item4ad3cb2d83.

https://www.ebay.com/itm/LOT-OF-10-Y-NOT-TOILET-SEAT-LIFTER-LIFT-LOWER-THE-SEAT-THE-CLEAN-WAY-/380419171068?pt=LH_DefaultDomain_0&hash=item5892bfe2fc.

http://www.ebay.com/itm/Jonny-Lift-Toilet-Seat-Lifter-Tabs-/271856443329?pt=LH_DefaultDomain_0&hash=item3f4be81fc1.

International Search Report PCT/IL2016/051248 Completed: Mar. 23, 2017; dated Apr. 10, 2017 3 pages.

Written Opinion of the International Searching Authority PCT/IL2016/051248 dated Apr. 10, 2017 10 pages.

* cited by examiner

UNIVERSAL LIFTER FOR TOILET SEAT AND LID

RELATED APPLICATIONS

This application is a National Phase of PCT Patent Application No. PCT/IL2016/051248 having International filing date of Nov. 21, 2016, which claims the benefit of priority of Israeli Patent Application No. 242774 filed on Nov. 25, 2015 entitled UNIVERSAL LIFTER FOR TOILET SEAT AND LID. The contents of the above applications are all incorporated by reference as if fully set forth herein in their entirety.

TECHNICAL FIELD

The present invention pertains to touch-free toilet seat lifters, and more particularly to selective, touch-free toilet seat lifters with the options of lifting the cover separately from the seat or the seat and cover together.

BACKGROUND

Growing concerns of transfer of infections and contaminations between users of toilets produce different hands-free solutions such as electronic remote control or manual devices for remote lifting of the seat. Bi-functional device for lifting the lid once separately from and second together with the seat is suggested in U.S. Pat. No. 6,842,916. This device comprises extendable handle that pulls a hook away from the lower side of the seat to allow separate lifting of the lid. The device attaches to the lid with a tongue and adhesive tape attached to it. While this is a bi-functional device, it requires repeated pulling out and pushing in the handle to switch between the two operations.

U.S. Pat. No. 5,619,758 describes a device for lifting toilet cover or toilet seat separately from each other, with a handle that creates a distance between the user that holds the device and the toilet bowl. The device may be distanced away from the bowl at fixed length intervals using extendable metal strip and a release button. The metal strip is used to determine the distance between the user and the toilet bowl. Although it is flexible it is not capable of transferring pressure applied on it to the clips of the device that hold to the cover or seat. Furthermore, it is not capable of transferring pressure to the lower arm of the clip separately from the upper arm, while leaving the upper arm in close contact with the upper surface of the cover or seat.

US 2014/0101833 describes a device for lifting toilet seat or cover that has a horizontal arm and two or more transverse teeth connected to the arm and are parallel each other. The device may also operate in conjunction with a rigid lever to lift the cover or seat. This mode of operation of the device is to hold the cover or seat between two teeth, lift it up by moving the lower tooth away from the lower surface and attach the upper tooth to the upper surface of the cover or seat The rigid structure of this device requires that it is distanced from the toilet bowl to exchange its hold from the cover to the seat. It is essentially rigid, which does not allow it to transfer pressure to the clip that holds to the cover or seat.

The present invention addresses the need for bi-functional touch-free toilet seat lifters having configurations different than those suggested in the prior art and that do not require excessive action for switching between states.

It is, therefore, an object of the present invention to provide bi-functional touch-free toilet seat lifter that is compact in size and requires only minimal effort in operation.

Other objects and embodiments of the present invention will become apparent as the description unfolds.

SUMMARY

In one aspect, the present invention provides bi-functional touch-free lifter for toilet lid and seat with structure that enables joint lifting of the toilet seat and lid and separate lifting of the lid from the seat. The lifter prevents contact with parts of the toilet with high risk of carrying contamination left after use and indirect transfer to other users. Further, users are provided with better sanitary conditions and feeling when not required to be physically exposed to possible contamination accumulated on the toilet seat and lid. Rather only a small area of a user thumb lightly contacts the lifter of the present invention, thus minimizing the exposure to potential contamination.

The basic structure of the lifter of the present invention comprises handle for lifting and lowering the lid or lid and seat together, engagement part for engaging with the lid, lower support for lifting the seat and flexible neck at the intersection between the handle, engagement part and lower support Essentially, the flexible neck is configured to transfer pressure applied on the handle to the lower support, disengage the contact of the lower support with the lower side of the seat and allow the lifting of the lid separately from the seat, leaving the seat laid horizontally on the edge of the toilet bowl. First, such structure requires only one device for both types of use of the toilet and for the two sexes, male and female. Second, it is compact in size and easily operated due to the flexible connecting neck that enables switching between separate and joint lifting of the lid and seat.

The basic structure of the lifter of the present invention encompasses several configurations. In one embodiment, the engagement part of the lifter is elongated tongue interfacing the upper or lower surfaces of the lid. The interface of the engagement part may be releasable adhesive double-sided tape attached to the engagement part lower or upper surfaces, respectively. Alternatively, the elongated tongue comprises releasable fastener such as releasable bump-groove coupling, particularly in the upper surface of the lid. In a third embodiment, the engagement is integrated with the lid, thus strongly fastening the lifter to the lid. The lower support of the lifter interfaces the lower surface of the seat and is configured to hold and lift the seat together with the lid. The lower support is also configured to respond to pressure applied on the handle, which is communicated to it through the flexible neck. As a result, the lower support is configured to disengage from the lower surface of the seat and move upwards with all other parts of the lifter engaged to the lid. Further, in one particular embodiment, the lower support is configured with such angle that enables it to slide back beneath the seat into the space of the toilet bowl upon sudden strike with the bowl edge. This may happen, for example, upon free fall from vertical to horizontal positions of the lid and seat on the bowl edge.

The engagement of the lifter is configured to hold and lift the lid and may be further backed with a middle support that Interfaces the lower surface of the lid. This addition forms a more confined space for the lid and further secures it between the engagement part and middle support when lifting it separately from the seat.

In still another particular embodiment, the flexible neck is seamlessly connected to the handle at the region between the handle, engagement part and lower support and on the same plane with the handle and engagement part. In such configuration the flexible neck appears as an extension or continuation of the handle. In still another embodiment, the flexible neck is on the same plane with the engagement part and handle, seamlessly forming a narrow region above the lower curved part that distinguishes between the handle and engagement part.

In one embodiment, the lifter is a monolithic single-molded polymeric unit (preferably polypropylene), with varying thicknesses of its different parts depending on their functionality. Particularly, the bendable zone is continuous with all other parts of the lifter, thinned and rendered weaker, with thickness smaller than that of the engagement part, handle and lower support For further flexibility and protection, the flexible neck may also be protected with rubber wrapping (i.e., neoprene).

The engagement part may attach to the upper surface of the lid with any detachable means, when it is not integrated with it. Particular examples are double-sided tape, Velcro and vacuum ring.

In still another embodiment, the handle is covered with antiseptic wrap. Such wrap may be liquid spray with slow decomposition and evaporation that provides further protection to consecutive users. In another option, the cover may be antiseptic tape releasably adhered to the handle surface. In still another option, the cover may be antiseptic glove removably dressed on the handle body. In another option, the handle itself can be made of anti-bacterial material embedded in the main polymer material of the handle.

The following describes non-limiting examples and configurations of the present invention as defined in its broader scope.

DETAILED DESCRIPTION OF THE DRAWINGS

Figure 1:
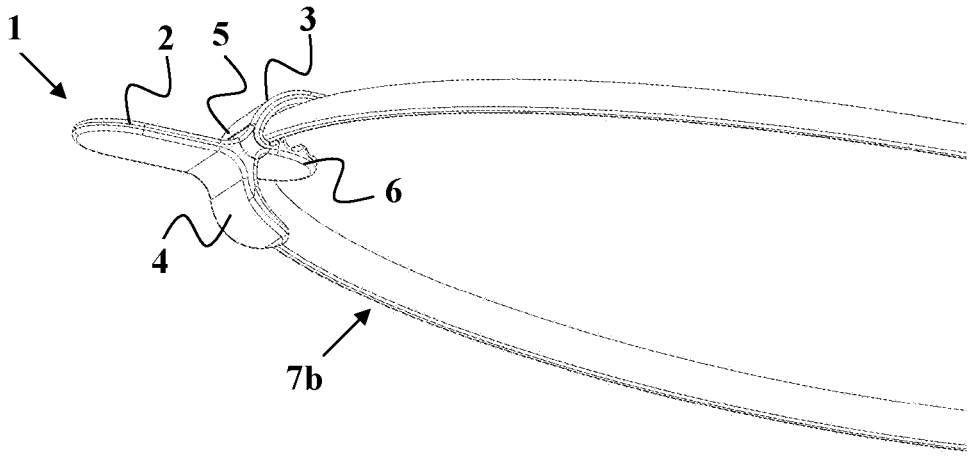
FIG. 1 illustrates particular configuration of the lifter engaged to a toilet lid.

The following describes particular non-limiting examples of a bi-functional touch-free toilet seat lifter of the present invention. These examples demonstrate possible ways for implementing the conceptual structure of the bi-functional touch-free toilet seat lifter and are to be construed only as exemplary for the most general configuration of such lifter.

The basic structure of the lifter of the present invention may take different configurations and designs as illustrated in FIGS. 1-9, 10-12, 13-14, 15 and 16. FIGS. 1-9 show different views of a lifter (1) configuration with the following parts:

- engagement part (3) in the form of elongated tongue extending on the upper surface of the lid (7*b*);
- handle (2) for holding and lifting and lowering the lid (7*b*) and seat (7*a*) with the lifter (1);
- lower support (4) engaged to the lower surface of the seat (7*a*) for lifting it together with the lid (7*b*);
- flexible neck (5) for transferring pressure applied on the engagement part (3) to the lower support (4); and
- middle support (6) for securing the holding of the lid (7*b*) together with the engagement part (3) upon lifting it.

Figure 2:
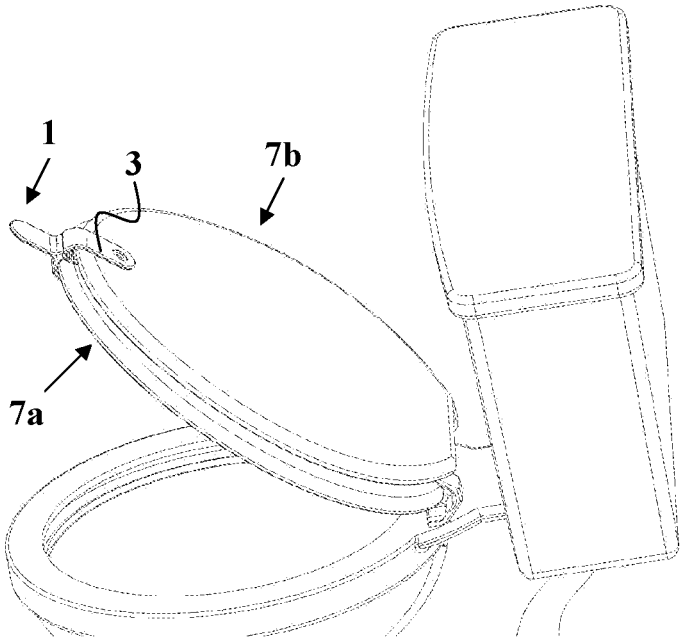
FIG. 2 is perspective view of particular configuration of the lifter engaged to the toilet seat and lid.
Figure 3:
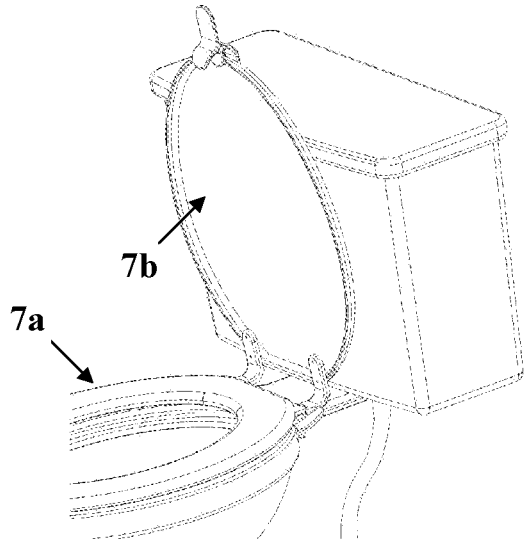
FIG. 3 is a view of particular configuration of the lifter engaged to a toilet lid in vertical position.
Figure 4:
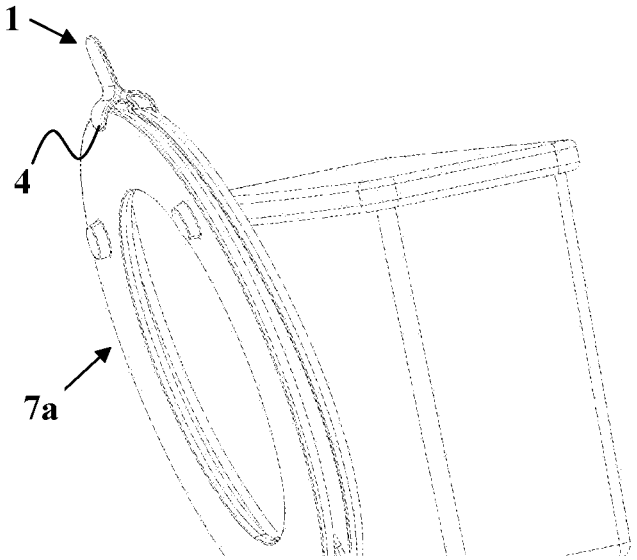
FIG. 4 is a view of particular configuration of the lifter engaged to the toilet seat and lid in vertical position.

As shown in FIGS. 2-4, the lifter (1) can lift the seat (7*a*) and lid (7*b*) together or the lid (7*b*) separately from the seat (7*a*), leaving the seat (7*a*) in horizontal position over the edge of the toilet bowl. The flexible neck (5) comprises essentially flexible cover and thin neck (5') within as shown in perspective and side views in FIGS. 8-9, respectively. The thin neck (5') is situated at the intersection between the handle (2), engagement part (3) and lower support (4). It is so designed as the thinner and weakest part in the lifter (1) configured to respond and receive pressure applied on the handle (2), when only lifting of the lid (7*b*) is desired. Then the neck (5') transfers that pressure to the lower support (4). The relatively small thickness of the thin neck (5') imparts it its flexibility and capability to receive the strain that the handle (2) experiences and translate it to the disengagement of lower support (4) from the lower surface of the seat (7*a*).

The middle support (6) extends forward from the intersection occupied by the flexible neck (5) and forms confined region around the lid (7*b*). This way, both the middle support (6) provides support to the lid (7*b*) from below. The middle support (6) thus further secures the lid (7*b*) in confined space and ensures its lifting, particularly in a case of disengagement of the engagement part (3) off of the upper surface of the lid (7*b*). The middle support (6) may be serrated as shown in perspective and cross-section views in FIGS. 6-7. Teeth (6') ensure better friction of the middle support (6) with the lower surface of the lid (7*b*), and prevent it from sliding along the surface upon application of pressure on the handle (2) and lifting of the lid (7*b*).

Figure 5:
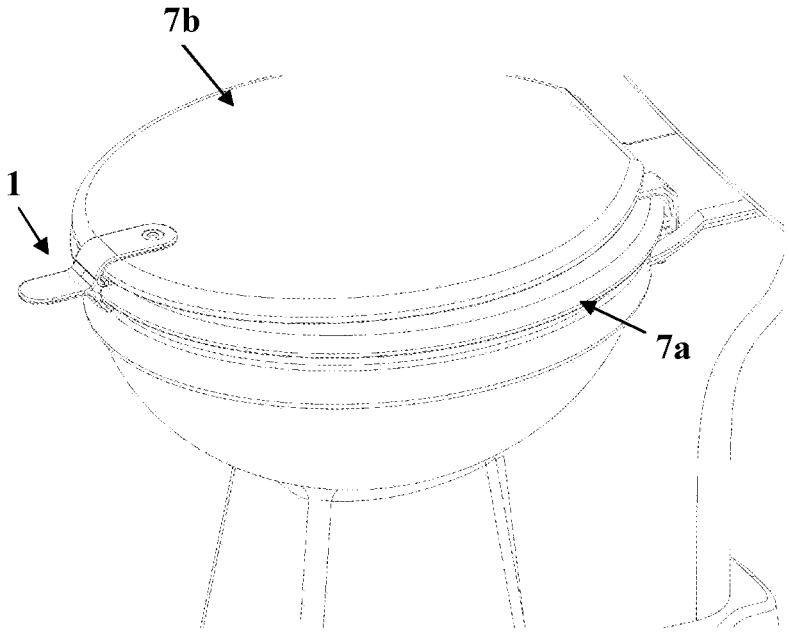
FIG. 5 is a view of particular configuration of the lifter engaged to the toilet seat and lid in horizontal position over the toilet bowl.
Figure 6:
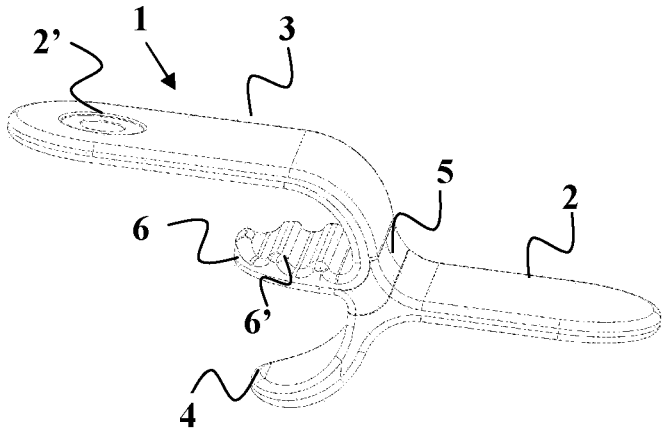
FIG. 6 is perspective view of particular configuration of the lifter of the present invention.
Figure 7:
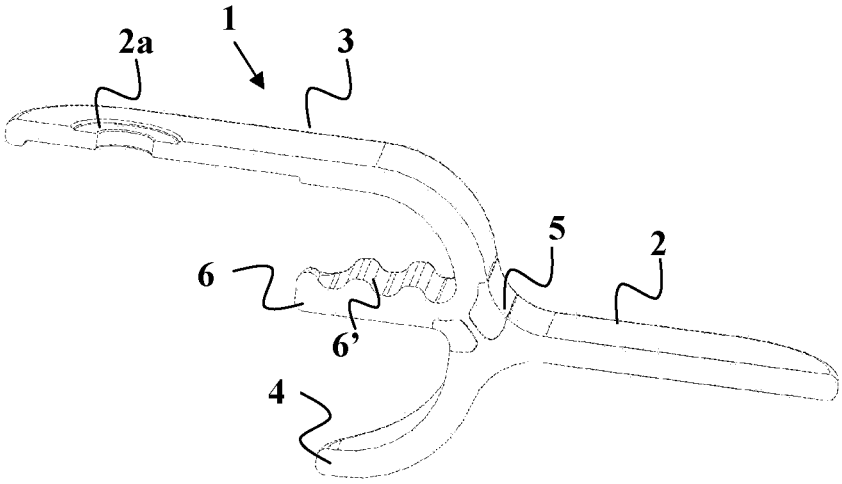
FIG. 7 is cross-section perspective view of particular configuration of the lifter of the present invention.
Figure 8:
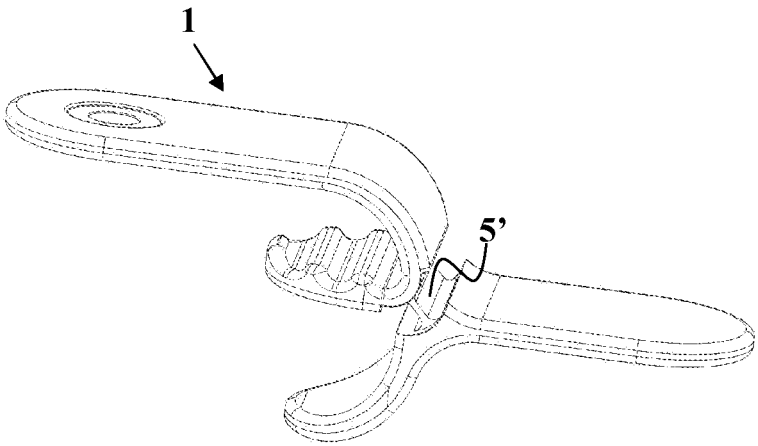
FIG. 8 is perspective view of particular configuration of the lifter with cover of flexible neck part removed.
Figure 9:
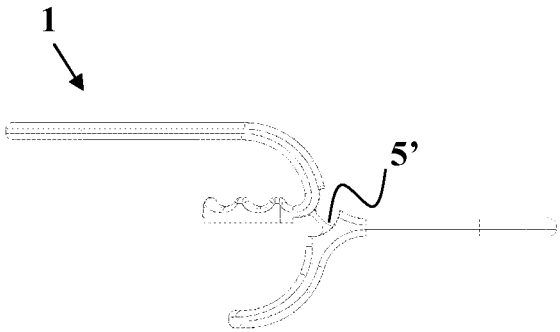
FIG. 9 is side view of particular configuration of the lifter with the flexible neck part exposed.

FIG. 5 shows the lifter (1) in horizontal position when seat (7*a*) and lid (7*b*) rest on the toilet bowl. The lifter (1) is obviously both functional and compact, not required to substantially extend outwards of the toilet edges to be able to lift the seat and lid.

Figure 10:
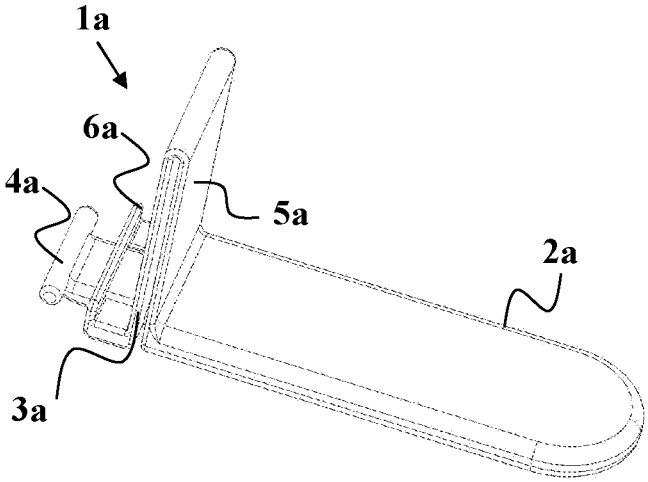
FIG. 10 illustrates another particular design of the lifter of the present invention.
Figure 11:
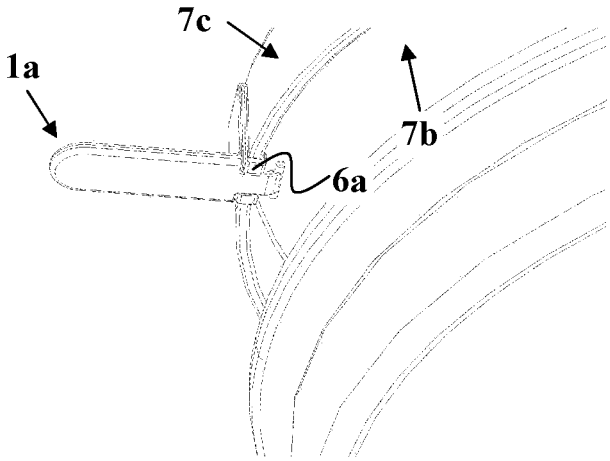
FIG. 11 is bottom view of the other design of the lifter engaged to the toilet lid.
Figure 12:
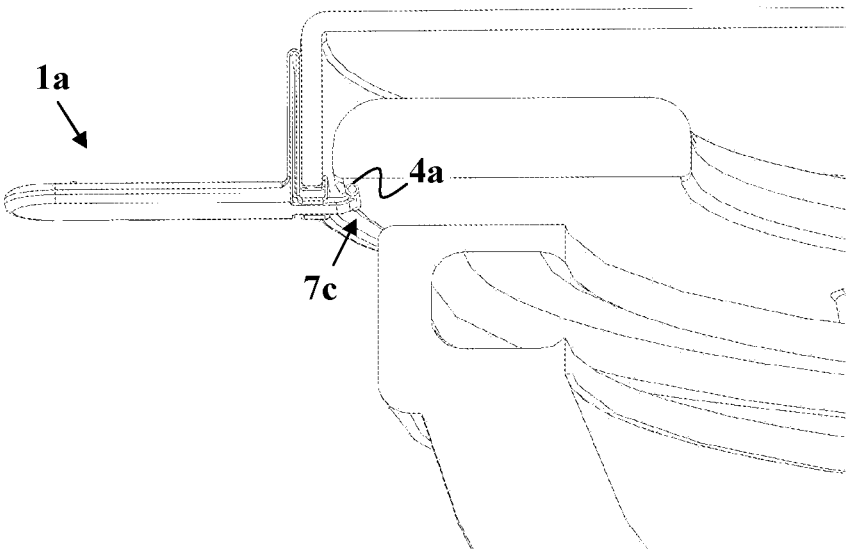
FIG. 12 is side view of the other design of the lifter engaged to the toilet seat and lid.

FIGS. 10-12 illustrate another configuration of a lifter (1*a*) of the present invention, for another type of toilet lid (7*b*) that covers completely the toilet seat (7*a*), that has perpendicular circumference edge strip (7*c*) where the handle (2*a*) is orthogonal to the engagement part (3*a*) and the edge strip (7*c*), the lower support (4*a*), which is a minimal narrow protrusion in contact with the edge strip (7*c*), and the middle support (6*a*). The lifter (1*a*) is designed to stop at the end of the movement, to prevent over-extension. The middle support (6*a*) is relatively short rectangular bar in contact with the edge strip (7*c*). This lifter (1*a*) has the same functionalities of that in the configuration of the lifter (1) in FIGS. 1-9. The flexible neck (5*a*) is located at the intersection between the handle (2*a*) and engagement part (3*a*) for transferring pressure applied to the handle (2*a*) and translated to the lower support (4*a*). The engagement part (3*a*) folds upon itself and forms continuous solid with the handle (2*a*), lower support (4*a*) and middle support (6*a*). The advantage of the lower support (4*a*) in this configuration is that it may be released much more easily below the seat and out of the bowl space due to its small size and limited movement, while preventing over-extension of the flexible neck (5*a*).

Figure 13:
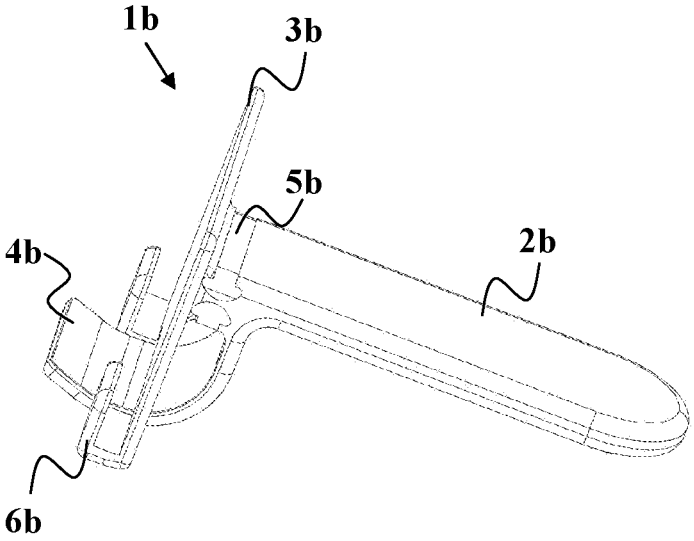
FIG. 13 illustrates third design of the lifter of the present invention.

FIG. 13 is illustration of another configuration of the lifter (1*b*), with handle (2*b*) communicating with engagement part (3*b*), lower support (4*b*) and middle support (6*b*) through flexible neck (5*b*). The flexible neck (5*b*) is on the same plane of handle (3*b*), where the lower support (4*b*) extends straight from handle (2*b*) body and is curve shaped. The engagement part (3*b*) is configured as rectangular plate that extends vertically downwards at its proximal end then turns in a straight angle to form a two-part middle support (6*b*) on the two sides of the lower support (4*b*).

Figure 14:
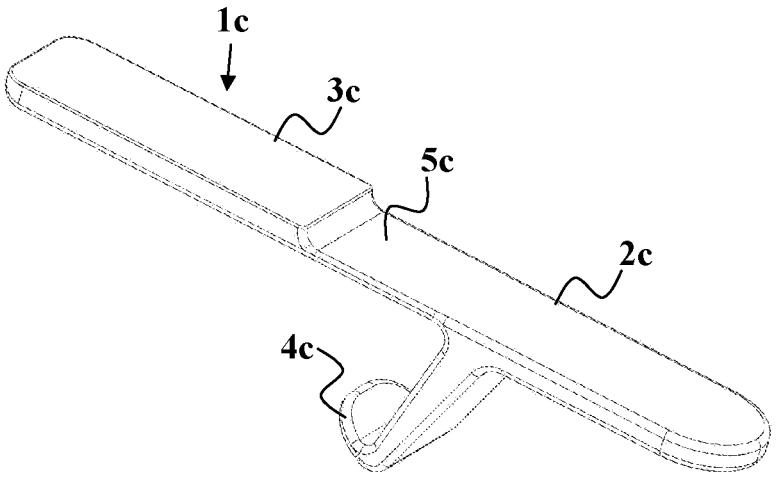
FIG. 14 illustrates another design of the lifter with seamless continuation of the flexible neck with the engagement part and bottom of the toilet lid.

FIG. 14 illustrates another configuration of the lifter (1*c*), where the flexible neck (5*c*) is relatively thinner part of the lifter, which has a self-flexibleness character. The flexible neck (5*c*) seamlessly continues the handle (2*c*) into the engagement part (3*c*). The lower support (4*c*) extends downwards from the handle lower surface in straight plane, and is inclined upwards at its distal end, which is in contact with the lower surface of the seat (7*a*).

Figure 15:
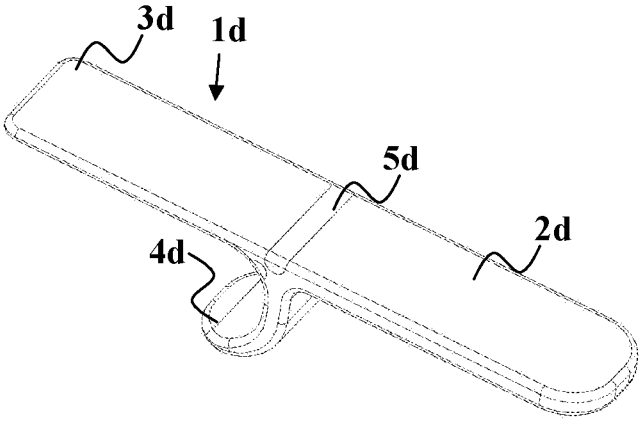
FIG. 15 illustrates another design of the lifter with flexible neck.

FIG. 15 is another configuration of the lifter (1*d*) with seamless connection between the handle (2*d*) and engagement part (3*d*) and above the lower support (4*d*). The lower support (4*d*) has a curved shape with distal edge slightly facing down.

Figure 16:
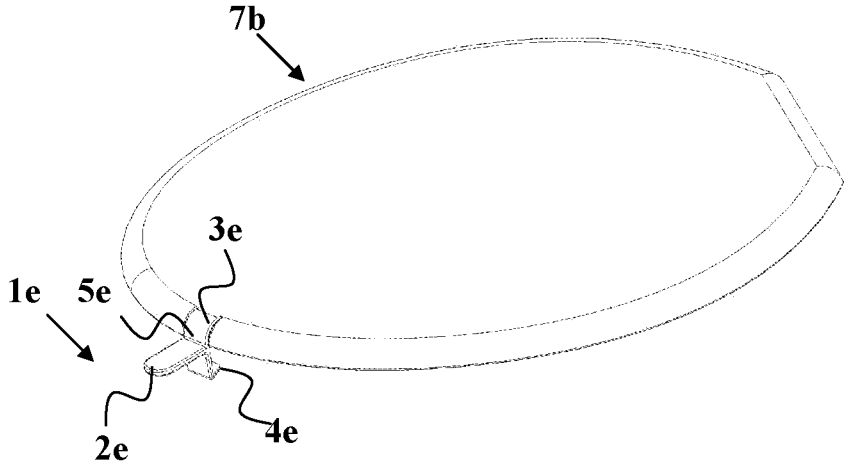
FIG. 16 illustrates another design of the lifter integrated with a toilet lid.

FIG. 16 illustrates another configuration of the lifter (1*e*), where the engagement part (3*e*) is merged with the lid (7*b*), the flexible neck (5*e*) is located at the border of the merging region with the lid (7*b*), where the handle (2*e*) and lower support (4*e*) extend outwards and downwards, respectively, from this merging region. The merging of the engagement part (3*e*) with the lid (7*b*) reinforces the connection of the lifter (1*e*) to the lid (7*b*) and ensures that it does not disengage from it upon an action of pulling up or away, whether intentional or not Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A lifter for lifting a seat and a lid of a toilet, said lifter comprising:

(a) a handle for manual holding of said lifter;

(b) an engagement part for engaging with said lid, said engagement part is folded upon itself and forms a continuous solid with said handle;

(c) a lower support for lifting said seat; and (d) a flexible neck at an intersection between said handle, said engagement part and said lower support, (e) a middle support between said engagement part and said lower support, wherein said flexible neck is configured to translate pressure applied on said handle to downward movement of said lower support, disengage contact of said lower support with a lower side of said seat and allow lifting of said lid separately from said seat, leaving said seat laid in a horizontal position over edges of a bowl of a toilet, wherein said handle is orthogonal to said engagement part and a circumference edge strip of seat of said toilet, wherein said lower support has a narrow protrusion, wherein said engagement part, said lower support and said middle support are parallel each other, wherein said lifter is configured to stop at an end of movement and prevent over-extension of said flexible neck.

2. The lifter according to claim 1, wherein said engagement part is an elongated tongue interfacing upper or lower surfaces of said lid, and an interface of said engagement part is areleasable adhesive double-sided tape attached to said lower or upper surfaces of said engagement part, respectively.

3. The lifter according to claim 1, wherein said engagement part is an elongated tongue interfacing upper or lower surfaces of said lid, wherein said elongated tongue comprises a releasable fastener on said upper or said lower surface, said releasable fastener is configured to engage with atop or a bottom surface of said lid.

4. The lifter according to claim 3, wherein said releasable fastener is selected from a coupling, hook and loop fasteners, a vacuum ring, or combinations thereof.

5. The lifter according to claim 1, wherein said engagement part is integrated with said lid.

6. The lifter according to claim 1, wherein said lower support interfaces a lower surface of said seat and is configured to hold and lift said seat together with said lid.

7. The lifter according to claim 6, wherein said lower support is configured to respond to pressure applied on said handle, disengage from said lower surface, and move out of a space confined by said bowl and upwards with all other parts of said lifter, said handle being in communication with said lower support through said flexible neck.

8. The lifter according to claim 1, wherein said lower support is configured in an angle enabling it to slide back beneath said seat into a space enclosed by bowl of said toilet upon contact with edges of said bowl.

9. The lifter according to claim 1, wherein said flexible neck is seamlessly connected to said handle at a region between said handle, said engagement part and said lower support, said flexible neck is configured on a same plane with said handle and said engagement part.

10. The lifter according to claim 1, wherein said flexible neck is configured as a narrow region above said lower part, said narrow region seamlessly connecting with said handle and said engagement part, said flexible neck configured to be on a same plane with said engagement part and said handle.

11. The lifter according to claim 1, wherein said lifter is a monolithic single-molded polymeric unit.

12. The lifter according to claim 11, wherein said flexible neck forms a continuous solid with all other parts of said lifter, said flexible neck is thinned and rendered weaker, with a thickness smaller than a thickness of said engagement part, said handle and said lower support.

13. The lifter according to claim 11, wherein said flexible neck comprises a flexible rubber wrap.

14. The lifter according to claim 11, wherein said flexible wrap is made of neoprene.

15. This lifter according to claim 1, wherein a configuration of said lower support is selected from upward curved shape, slightly downward curved shape and cylinder shape.

16. The lifter according to claim 1, further comprising an antiseptic cover on said handle, said antiseptic cover is selected from antiseptic spray, releasable antiseptic tape and removable antiseptic glove.

17. The lifter according to claim 1, wherein said handle comprises an anti-bacterial material embedded within polymeric material of which said handle is made.

18. A lifter for lifting a seat and a lid of a toilet, said lifter comprising:

(a) a handle for manual holding of said lifter;

(b) an engagement part for engaging with said lid;

(c) a lower support for lifting said seat; and (d) a flexible neck at an intersection between said handle, engagement part and lower support, said flexible neck is configured to translate pressure applied on said handle to downward movement of said lower support, disengage contact of said lower support with a lower side of said seat and allow lifting of said lid separately from said seat, leaving said seat laid in a horizontal position over edges of a bowl of said toilet, (e) a middle support, said middle support interfacing a lower surface of said lid, wherein said middle support is monolithically continuous with said engagement part and comprises two parts extending horizontally relative to said engagement part on two sides of said lower support, wherein said engagement part is configured as a horizontal rectangular plate extending vertically downwards, and wherein said flexible neck is configured on a same plane of said handle and seamlessly connected to said handle and engagement part, and wherein said lower support extending straight from said handle and is curve shaped.

19. The lifer according to claim 18, wherein said middle support comprises a serrated upper surface.

* * * * *